US005269444A

United States Patent [19]

Wright

[11] Patent Number: 5,269,444

[45] Date of Patent: Dec. 14, 1993

[54] FOAMING DEVICE

[76] Inventor: H. Earl Wright, 12 8th Dr., Decatur, Ill. 62521

[21] Appl. No.: 897,479

[22] Filed: Jun. 12, 1992

[51] Int. Cl.[5] ..... B67D 5/00

[52] U.S. Cl. ..... 222/190; 222/211; 222/209; 239/346

[58] Field of Search ..... 222/189, 190, 211, 400.7, 222/400.8, 401, 207, 209, 321, 396, 397, 394; 239/327, 343, 346, 353

[56] References Cited

U.S. PATENT DOCUMENTS

| | | | |
|---|---|---|---|
| 1,457,895 | 6/1923 | Campanella | 239/343 X |
| 1,888,768 | 11/1932 | Lach | 222/190 |
| 1,919,257 | 7/1933 | Renzenhausen | 222/400.8 X |
| 2,119,906 | 6/1938 | Dorman | 222/190 X |
| 2,652,952 | 9/1953 | Mowbray | 222/325 X |
| 3,428,222 | 2/1969 | Wright | 222/187 |
| 3,709,437 | 1/1973 | Wright | 222/190 X |
| 3,937,364 | 2/1976 | Wright | 222/190 |
| 4,018,364 | 4/1977 | Wright | 222/190 |
| 4,184,615 | 1/1980 | Wright | 222/190 |
| 4,274,560 | 6/1981 | Cater | 222/321 |
| 4,531,659 | 7/1985 | Wright | 222/190 |
| 4,531,660 | 7/1985 | Ford, Jr. | 222/401 X |
| 4,880,161 | 11/1989 | Wright | 222/190 X |
| 4,932,567 | 6/1990 | Tanabe et al. | 222/190 |
| 4,957,218 | 9/1990 | Ford, Jr. | 222/190 X |

*Primary Examiner*—Andres Kashnikow
*Assistant Examiner*—Anthoula Pomrening
*Attorney, Agent, or Firm*—Philip L. Bateman

[57] ABSTRACT

A foam dispensing device mixes a foamable liquid with compressed ambient air and dispenses a foam having the desired liquid-to-air ratio at an early time during foam dispension. The device, which has a vertical liquid conduit and a restricted air passage leading to a mixing chamber, also has two one-way pressure-activated valves to delay the flow of air and to accelerate the flow of liquid to the mixing chamber when the compressed air is introduced. The first valve is located in the liquid conduit below the air passage to prevent liquid from flowing down the tube, thereby accelerating the flow of liquid when the compressed air is introduced. The second valve is located above the air passage to delay air flow.

5 Claims, 2 Drawing Sheets

Fig. 2
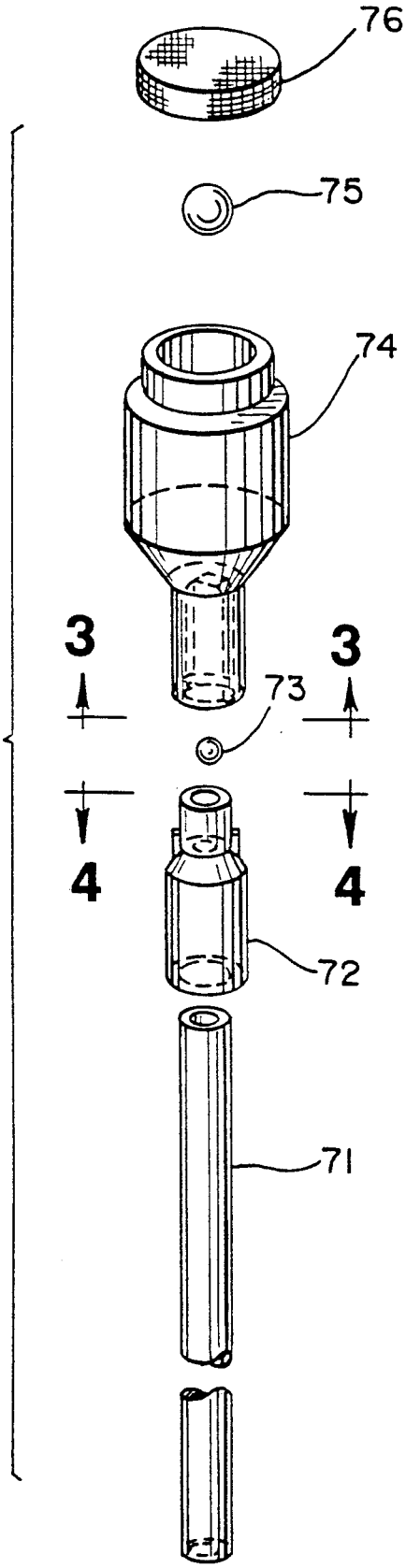
Fig. 3
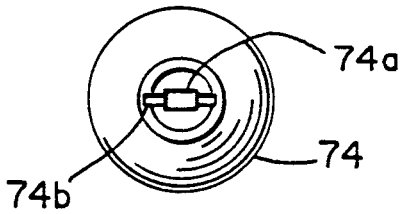
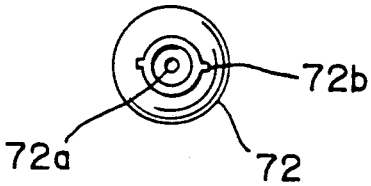
Fig. 4

FOAMING DEVICE

FIELD OF THE INVENTION

This invention relates to foaming devices. More particularly, this invention relates to devices which dispense a foam generated by mixing a foamable liquid with air when the device is compressed manually.

BACKGROUND OF THE INVENTION

Devices for generating and dispensing foams by manual compression of a reservoir, bulb, or bellows are well known. The compression typically forces air and foamable liquid from a reservoir into a mixing chamber where they mix to produce a foam before being dispensed from the device. Such devices are disclosed in a series of patents and patent applications of H. Earl Wright: U.S. Pat. No. 3,428,222, issued Feb. 18, 1969; U.S. Pat. No. 3,709,437, issued Jan. 9, 1973; U.S. Pat. No. 3,937,364, issued Feb. 10, 1976; U.S. Pat. No. 4,018,364, issued Apr. 19, 1977; U.S. Pat. No. 4,184,615, issued Jan. 22, 1980; U.S. Pat. No. 4,531,659, issued Jul. 30, 1985; U.S. Pat. No. 4,880,161, issued Nov. 14, 1989; and U.S. patent application Ser. No. 07/869,861, filed Apr. 16, 1992; now U.S. Pat. No. 5,219,102; each of which is incorporated by reference.

Most prior art foaming devices, including those disclosed in the Wright patents and patent applications, share a number of common elements. Each foamer contains a reservoir for storing the foamable liquid and a quantity of air, and further contains a means for supplying compressed air. The reservoir itself may be manually compressible or a separate, compressible air supplying means may be connected to the reservoir. Each foamer contains a mixing chamber where the foamable liquid and air mix to form the foam. Each contains a restricted passage for the flow of air to the mixing chamber. Each contains a passage from the liquid reservoir to the mixing chamber, typically a vertical dip tube. And each contains some means for dispensing foam from the mixing chamber. As mentioned above, these foamers are all operated by compressing the air supplying means which, in turn, forces air and foamable liquid into the mixing chamber. When the air supplying means is released, the vacuum created thereby draws air and undispensed foam from within the device back into the reservoir.

The ratio of foamable liquid to air supplied to the mixing chamber is critical to foam formation in these devices. If the ratio is too high, the foam is too wet. If the ratio is too low, the foam is too dry. Because of the importance of this ratio, many of the foamers disclosed in the Wright patents and patent applications are specifically designed to maintain a relatively constant liquid-to-air ratio. For example, the foamer disclosed in U.S. patent application Ser. No. 07/869,861 now U.S. Pat. No. 869,861, separates returning foam from the air passage inlet to prevent foam from entering the air passage (and thereby making the dispensed foam too wet) if the foamer is compressed again without delay. As another example, the foamer disclosed in U.S. Pat. No. 4,880,161 employs a flexible diaphragm to independently meter the liquid and air to the mixing chamber.

While the Wright foamers have enjoyed great commercial success, they all exhibit a lag from the time the reservoir is compressed to the time the foam having the desired liquid-to-air ratio is dispensed. In the Wright foamers of the upright type, the initial compression first produces the expulsion of air, rather than foam, because it takes some amount of time for the liquid to rise up the vertical dip tube, pass through the mixing chamber, and exit the device. This also results in the initial foam dispensed being on the dry side.

It would be desirable for a foaming device to produce foam having the desired liquid-to-air ratio immediately upon compression of the air supplying means. However, none of the foamers shown in the prior art exhibits this characteristic.

SUMMARY OF THE INVENTION

The general object of this invention is to provide an improved foaming device. A more particular object is to provide a foaming device which dispenses a foam having the desired liquid-to-air ratio at an early time during foam dispension.

I have invented a foam dispensing device of the type which dispenses foam upon manual compression of an air supplying means and which remains upright during use, which device further dispenses a foam having the desired liquid-to-air ratio at an early time during foam dispension, which device comprises: (a) a compressible air supplying means adapted to supply air at superatmospheric pressure when compressed and to replenish its air supply when released; (b) a reservoir adapted to contain foamable liquid at its bottom and air as its top; (c) a mixing chamber located above the liquid level in the reservoir in which the foamable liquid and air from the reservoir mix to form a foam; (d) a means for dispensing the foam from the device; (e) a conduit for foam from the mixing chamber to the foam dispensing means; (f) a vertical conduit for liquid extending from below the liquid level in the reservoir to the mixing chamber, through which the foamable liquid flows upwardly when the air supplying means is compressed; (g) a restricted air passage from the air space in the reservoir to the mixing chamber; (h) a first, one-way, pressure-activated valve means which opens during compression of the air supplying means and which closes upon its release, which valve means is located in the liquid conduit below the restricted air passage to prevent the flow of liquid down the liquid conduit to the liquid in the reservoir when the air supplying means is released; and (i) a second, one-way, pressure-activated valve means which opens during compression of the air supplying means and which closes upon its release, which valve means is located above the restricted air passage to delay the flow of air to the foam dispensing means.

The foam dispensing device of this invention, once primed, remains primed and capable of immediately dispensing foam of the desired liquid-to-air ratio.

BRIEF DESCRIPTION OF THE DRAWINGS

FIG. 2 is an exploded, perspective view of the foamer body of the device shown in FIG. 1.

FIG. 3 is a bottom view of one component of the foamer body, taken along line 3—3 of FIG. 2.

FIG. 4 is a top view of another component of the foamer body, taken along line 4—4 of FIG. 2.

DETAILED DESCRIPTION OF THE INVENTION

Figure 1:
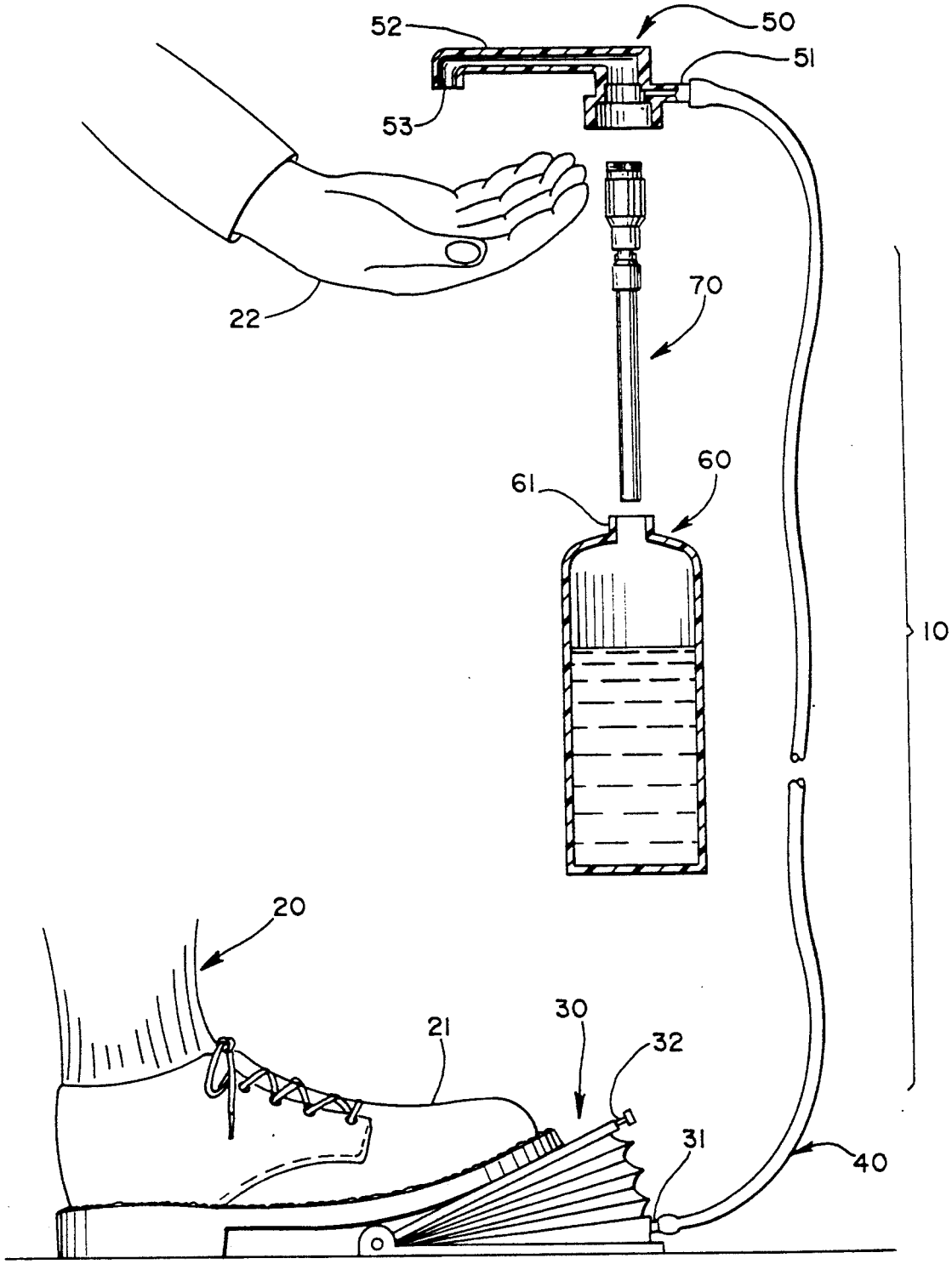
FIG. 1 is a view of one embodiment of the foam dispensing device of this invention, partly in perspective and partly in section.

This invention is best understood by reference to the drawings. FIG. 1 shows one embodiment of the foaming device 10 of this invention. A user 20 desiring to obtain foam from the device has placed his foot 21 on a foot bellows 30 and his hand 22 in a position to receive the foam. The foot bellows is connected by a tube 40 to the other components of the device, which are advantageously mounted on a wall at hand level near a sink. In FIG. 1, the other components are shown exploded for convenience. The other components include a cap 50, a reservoir 60, and a foamer body 70 (shown in more detail in FIGS. 2, 3, and 4). Each of the components of the foam dispensing device is discussed in detail below.

The foot bellows is of a conventional design and is adapted for supplying air at superatmospheric pressure when compressed. Compressed air from the bellows is discharged through outlet 31. When the bellows is released, ambient air is admitted through inlet 32. The inlet is closed during compression of the bellows. While a foot bellows is a convenient means for supplying compressed air because it leaves both hands free, other compressible air supplying means are also suitable. For example, a manually compressible bulb on top of the reservoir, as shown in FIGS. 1, 2, and 3 of Wright, U.S. Pat. No. 4,880,161, functions effectively. As another example, the reservoir itself may be compressible, as shown in Wright, U.S. patent application Ser. No. 07/869,861, now U.S. Pat. No. 5,219,102.

An airtight tube 40 connects the foot bellows to the other components of the device. The tube typically has an inside diameter of about 3 mm and is formed of a flexible material such as low-density polyethylene.

The cap 50 serves several functions in the device. Inlet 51 is connected to the tube and the lower, interior portion of the cap forms a passageway for the flow of air down into the reservoir. The cap also contains an extended arm 52 through which and out of which foam is dispensed. The arm shown in FIG. 1 is rigid, but it may be flexible, telescoping, etc. The arm typically extends out past the reservoir a sufficient distance, generally about 5 to 15 cm, to enable the hands to be placed under its discharge 53. If desired, a cap is used at the discharge end to prevent dripping and/or spills during movement of the device. The cap is adapted to mate in an airtight manner with the reservoir. As shown, the cap snaps into position on the reservoir. This means of connection has the advantage that the cap can be rotated 360 degrees about its axis to position the discharge where desired. The cap can also be mated to the reservoir by means of threads, as shown in FIG. 4 of Wright, U.S. Pat. No. 4,880,161, or by other suitable means.

The reservoir 60 is adapted to contain foamable liquid at its bottom and air at its top. It typically has an internal volume of about 0.1 to 2 liters. When the compressible air supplying means is separate from the reservoir, as in the embodiment shown in FIG. 1, the reservoir is typically constructed of a rigid material such as glass, high-density polyethylene, or high-density polypropylene. Alternatively, when the reservoir is itself the compressible air supplying means, it is constructed of a flexible, deformable material such as low-density polyethylene. As previously mentioned, the reservoir has means for securing the cap. In the embodiment shown in FIG. 1, the reservoir contains an extended neck portion 61 upon which the cap is snapped. As explained in more detail below, the liquid level is maintained below the level of the inlet of the restricted air passage and above the inlet of the liquid conduit.

As shown in FIG. 1, the foamer body 70 fits securely within the cap and extends downward into the reservoir. The mating of the foamer body and the cap also serves to separate the interior of the cap into two regions: (1) an incoming air flow region; and (2) an outgoing foam flow region. The foamer body is shown in greater detail in FIGS. 2, 3, and 4. A vertical conduit 71, commonly referred to as a dip tube, extends downward below the liquid level to a point near the bottom of the reservoir. The device ceases to function as a foamer if the liquid level falls below the bottom of the dip tube inlet. The dip tube generally has an inside diameter of about 3 mm.

The dip tube is inserted into a first valve body 72. The valve body contains an opening **72*a* at the bottom of a conical compartment housing a ball 73. The opening is sized smaller than the ball so that, when the ball rests over the opening, an airtight seal is made. The ball generally has an outside diameter of about 1 to 2 mm and is constructed of a noncorrosive, relatively dense material such as stainless steel. As shown in FIG. 2**, the first valve body is located at the top of the dip tube. It functions equally well at the bottom of the dip tube, or at any point in between. As explained below, the primary function of the first valve means is to prevent the flow of liquid back down the dip tube when the air supplying means is released.

The first valve body is shown inserted into a second valve body 74. Protrusions **72*b* on the first valve body are engaged when the two valve bodies are properly connected. This second valve body also contains an opening 74*a* at the bottom of a conical compartment housing a ball 75. As with the first valve, the opening 74*a* is sized smaller than the ball so an airtight seal is made when the ball rests over the opening. The ball 75 generally has an outside diameter of about 2 to 3 mm and is constructed of a material similar to the first ball. The function of the second ball valve is to delay the flow of air through the mixing chamber and out of the device. The amount of delay is determined, in part, by the weight of the ball. Typically, the pressure required to unseat the second ball 75 is greater than that required to unseat the first ball 73. The top of this compartment is closed with a porous screen 76. As will be explained, this compartment acts as a mixing chamber where foamable liquid and air from the reservoir mix to form a foam. The interior of the lower portion of the second valve body contains two recessed channels 74*b* leading to the opening 74*a*. These channels are seen most clearly in FIG. 3**. The function of these channels is to provide a restricted air passage from the air space in the reservoir to the mixing chamber.

The operation of the foam dispensing device is as follows. A suitable quantity of foamable liquid is poured into the reservoir. The liquid level in the reservoir should be high enough that, when assembled, the dip tube reaches the liquid. The liquid level should be low enough that the inlets to the air passages are not submerged. It is convenient to use a reservoir with a neck sufficiently long that the liquid level can come up to the neck without submerging the air channel inlets. After partially filling the reservoir, the foamer is assembled and is ready for use. As will be seen, the major advantages of the foam dispensing device of this invention are not realized until it has been primed by undergoing one foam dispension cycle.

When foam is desired for the first time and/or to prime the device, the hands are placed under the discharge of the cap and the foot bellows is depressed with a foot. The reduction in volume brought about by the depression increases the air pressure and forces air through the tube and into the reservoir. The increased pressure in the reservoir, in turn, forces liquid up the dip tube and air into the air channels. Both ball valves are unseated as the liquid and air mix in the mixing chamber to form the foam. However, because of the time lag for the liquid to rise up the dip tube, there is typically some air discharged first from the device, followed by foam which is relatively dry because of a low liquid-to-air ratio. The foam is homogenized as it passes through the porous screen. The foam then passes upward through the cap and out the discharge into the hands of the user.

When the foot bellows is released, the air pressure in the bellows-tube-reservoir system drops which, in turn: (1) allows the ball valve 75 to drop down to seal off opening 74*a*; (2) allows the ball valve 73 to drop down to seal of opening 72*a*, which thereby prevents the flow of liquid back down the dip tube; and (3) allows ambient air to enter the air bellows through inlet 32.

After this first cycle is completed, the device is primed and ready for subsequent use. When the foot bellows is depressed the next time, the liquid passes into the mixing chamber much more promptly because it is already at or near the top of the dip tube and does not need to rise up the dip tube's entire length. Furthermore, the ball valve 75 resists the flow of air through the mixing chamber until the pressure builds within the system. This combined acceleration of liquid flow and retardation of air flow results in the initial foam being produced at a nearly ideal liquid-to-air ratio.

I claim:

1. A foam dispensing device of the type which dispenses foam upon manual compression of an air supplying means and which remains upright during use, which device further dispenses a foam having the desired liquid-to-air ratio at an early time during foam dispension, which device comprises:

(a) a compressible air supplying means adapted to supply air at superatmospheric pressure when compressed and to replenish its air supply when released;

(b) a reservoir adapted to contain foamable liquid at its bottom and having an air space at its top;

(c) a mixing chamber located above the liquid level in the reservoir in which the foamable liquid and air from the reservoir mix to form a foam;

(d) a means for dispensing the foam from the device;

(e) a conduit for foam from the mixing chamber to the foam dispensing means;

(f) a vertical conduit for liquid extending from below the liquid level in the reservoir to the mixing chamber, through which the foamable liquid flows upwardly when the air supplying means is compressed;

(g) a restricted air passage from the air space in the reservoir to the mixing chamber;

(h) a first, one-way, pressure-activated valve means which opens during compression of the air supplying means and which closes upon its release, which valve means is located in the liquid conduit below the restricted air passage to prevent the flow of liquid down the liquid conduit to the liquid in the reservoir when the air supplying means is released; and (i) a second, one-way, pressure-activated valve means which opens during compression of the air supplying means and which closes upon its release, which valve means is located in the mixing chamber above the restricted air passage to delay the flow of air to the foam dispensing means until sufficient pressure has accumulated.

2. The foam dispensing device of claim 1 wherein the air supplying means comprises a foot bellows.

3. The foam dispensing device of claim 2 wherein the first, one-way, pressure-activated valve means has a lower activation-pressure than the second valve means to allow upward flow of liquid to the mixing chamber before the second valve means opens.

4. The foam dispensing device of claim 3 wherein the first and second valve means comprise ball valves.

5. The foam dispensing device of claim 4 additionally comprising a porous screen located between the mixing chamber and the foam dispensing means.

* * * * *